US005605283A

United States Patent [19]

Lahnsteiner et al.

[11] Patent Number: 5,605,283

[45] Date of Patent: Feb. 25, 1997

[54] WELD JOINT BETWEEN TWO RAILS ARRANGED BEHIND EACH OTHER ALONG A RAIL TRACK

[75] Inventors: Robert Lahnsteiner, Wels; Julius Ehrlich, Vienna, both of Austria

[73] Assignee: Fronius Schweissmaschinen KG. Austria, Wels/Thalheim, Austria

[21] Appl. No.: 586,538

[22] Filed: Jan. 16, 1996

Related U.S. Application Data

[63] Continuation of Ser. No. 349,458, Dec. 5, 1994, abandoned, which is a continuation of Ser. No. 983,774, Dec. 1, 1992, abandoned.

[30] Foreign Application Priority Data

Dec. 3, 1991 [AT] Austria ..... 2396/91

[51] Int. Cl.[6] ..... E01B 11/44

[52] U.S. Cl. ..... 238/164; 238/163; 228/226; 219/54; 219/53

[58] Field of Search ..... 238/163, 164; 104/15; 228/225, 226; 219/53, 54, 55, 76.12

[56] References Cited

U.S. PATENT DOCUMENTS

| | | | |
|---|---|---|---|
| 804,763 | 11/1905 | Pahde | 219/55 X |
| 1,959,791 | 5/1934 | Kautz | 228/226 |
| 2,060,765 | 11/1936 | Welch | 238/164 X |
| 2,868,951 | 1/1959 | Shrubsall . | |
| 3,308,266 | 3/1967 | Adams . | |
| 3,527,919 | 9/1970 | Stern et al. . | |
| 4,196,335 | 4/1980 | Ikeda et al. | 219/76.12 X |
| 4,896,814 | 1/1990 | Allain et al. | 228/226 X |
| 5,175,405 | 12/1992 | Karimine et al. | 219/54 |

FOREIGN PATENT DOCUMENTS

| | | | |
|---|---|---|---|
| 148217 | 12/1936 | Austria | 238/164 |
| 150333 | 8/1937 | Austria | 238/164 |
| 1191922 | 9/1963 | Germany . | |
| 1565894 | 9/1966 | Germany . | |
| 1565441 | 10/1966 | Germany . | |
| 2432183 | 1/1976 | Germany | 228/226 |
| 0073494 | 6/1980 | Japan | 228/226 |
| 0180780 | 7/1989 | Japan | 219/54 |

*Primary Examiner*—Karen B. Merritt
*Assistant Examiner*—Stephen Gordon
*Attorney, Agent, or Firm*—Collard & Roe, P.C.

[57] ABSTRACT

Two rail sections are joined by a weld joint (5) between two rails (1,2) arranged one behind another in a lengthwise direction of a rail track (4) and a method for the production of this weld joint (5). The frontal ends (6,7) of the rails (1,2) which are facing each other are connected with one another by a filler material (8), which extends from the rail foot (32) to the rail head (30). The weld joint (5) is composed of a welding zone (22, 23, 24, 25) which connects the rail foot (32), the stem of the rail (31) and the rail head (30). The welding zones (22 to 25) are connected in a form-locking manner in the contact areas (33 to 36) immediately facing each other. Furthermore, the welding zone (22) of the rail head (30) consists of less than 15 neighbouring, molten beads (26) preferably situated one above another and approximately running parallel to each other. The welding zone (24, 25) of the rail foot (32) consists of less than 10 neighbouring, molten beads (28, 29) which run approximately parallel to each other.

4 Claims, 6 Drawing Sheets

WELD JOINT BETWEEN TWO RAILS ARRANGED BEHIND EACH OTHER ALONG A RAIL TRACK

This is a continuation of our application Ser. No. 08/349,458, filed Dec. 5, 1994 and now abandoned, which is a continuation of Ser. No. 07/983,774, filed Dec. 1, 1992, now abandoned.

BACKGROUND OF THE INVENTION

1. Field of the Invention

The present invention relates to a weld joint between two rails arranged behind each other along a rail track.

2. The Prior Art

The invention relates to a weld joint between two longitudinally adjoining and aligned rail sections, each rail section having a rail foot, a rail stem and a rail head forming a running surface, the adjoining rail sections having facing ends defining a gap therebetween and the weld joint connecting the facing ends of the adjoining rail sections.

Various methods are already known for the joining of facing ends of immediately successive rail sections of a rail used in railway or tramway tracks, for example. If such joint weldings are made in laid tracks, the so called aluminothermic welding process is often used. During aluminothermic welding metal powder is melted and in its liquid state poured into a mould which surrounds the rail ends so that, like in a kind of casting process, the gap is filled between the opposite faces of the facing ends of the rail sections which face each other, thus ensuring a good connection between them.

Another welding method used is the flash-butt welding process, which is used to weld rails in laid tracks but is particularly useful for the production of weld joints in rail warehouses. This method keeps the abutting surfaces during current passage in such slight contact that the material burns away continuously at the small local contact points due to high current density. The liquid metal is then ejected from the abutting point. When the consumption zone is deep enough, welding is done by abrupt upsetting and simultaneous interruption of circuit. The liquid material which was squeezed out of the rail gap causes the development of a burr at the weld. This burr is removed by shearing and subsequent grinding.

Moreover, in track systems having a high level of rail load and wear, particularly in curves, it is customary to rebuild the rail head section through resurface welding. For this purpose open or submerged arc welding or shielded arc welding is often used to deposit filler material onto the rails, especially in the region of the rail head flanks. The material which juts out is then removed by grinding, thus producing the required shape of the rail head.

SUMMARY OF THE INVENTION

The object of the present invention is to create a weld joint between two successively arranged end aligned rail sections, which consists of several individual weld seams and which can be produced by manual arc welding as well as by automatic welding processes within a short period and without expensive mechanical equipment.

This object of the invention is achieved with a weld joint between two adjoining and aligned rail sections extending in a longitudinal direction, each rail section having a rail foot, a rail stem and a rail head forming a running surface, the adjoining rail sections having facing ends extending parallel to each other and transversely to the longitudinal direction. The facing ends define a gap therebetween and the weld joint connecting the facing ends of the adjoining rail sections comprises at least one welding zone at the rail section feet, a second welding zone at the rail section stems, and a third welding zone at the rail section heads. The welding zones consist of superposed rows of abutting beads of a material filling the gap, the beads in the welding zones extend substantially parallel to each other and transversely to the longitudinal direction of the rail sections, and the beads adjacent each other in the longitudinal direction overlap each other and are offset in the longitudinal direction. Adjoining areas of the welding zones are interlocked with each other, the at least one welding zone consists of at least three and no more than ten beads, the second welding zone consists of at least three and no more than sixteen beads, and the third welding zone consists of least three and no more than fifteen beads.

The advantage of this solution is that, due to the arrangement of several welding zones in which the thicknesses of the material remain about the same, the basic materials are sufficiently melted and that a close bond can be achieved between the basic material and the weld metals. Above all, this makes it possible to connect and fill in the thicker regions of the cross section by several weld seams arranged next to each other or above one another. This permits that the total temperature influence on the rail track, especially in the region of the weld, is kept at a minimum, and that all embrittlements in the welding region are avoided. A further advantage of this solution is that welding can now take place in an inert gas atmosphere which allows no access of oxygen into the heated or respectively plasticized regions of the rails.

In another embodiment, the filler material shows more resistance and hardness in a surface area immediately facing at least one running surface of the rail track than in the other welding zones. With this weld joint, it is now possible to apply more resistant and harder materials in the regions exposed to greatest wear and tear, whereby the applied layer thickness and the region where these materials are used, can be freely chosen, and the weld joint can still be produced in a single operation.

In a further embodiment, the welding zones are produced with different filler materials, it is also advantageous, inasfar as the different loads in various regions of the rails can also be taken into account during the production of the weld joint.

In other embodiment the welding zones are produced in several layers and preferably, at least in individual layers produced of different filler materials allows for a very satisfactory weld joint production using a large number of structurally similar layers, which brings about a uniform joint structure over the entire weld joint and results in a highly resistant weld joint. In addition, with the adaptation and use of various layers consisting of different weld metals within the individual welding zones, it is possible to use for example reinforcement sections and beads or ductile layers with highly elastical form change properties.

In another embodiment the hardness, the modulus of elasticity and the tensile strength of the filler materials in the welding zones and the layers in direction of the running surface and in the direction of the rail foot are linearly and/or exponentially changed avoids inner stress zones within the transition zone between materials with different elasticity or respectively stress or bending properties, since there are no sudden changes in the individual resistance values.

Moreover, the invention includes a method for the production of a weld joint between the facing ends of the rail sections of a rail track, wherein the two said facing ends of the rail sections are apart from each other by the thickness of a welding gap.

This method is characterized by using a protective gas of 40% to 70% argon, 25% to 60% helium, 3% to 10% carbon dioxide and 0.1% to 1% oxygen and a consumable electrode having a diameter of 0.8 mm to 0.4 mm and an amperage in the range of 100 to 1 100 amperes, beads are applied one above another in a welding zone in the region of the rail foot, whereupon the beads are produced in welding zones located in the area of the rail stem and the rail head, wherein the welding zone of the rail foot is produced by not more than 10 beads above one another and the welding zone of the rail head by not more than 15 beads above one another. The advantages of such a weld joint production process are derived from the fact that a special protective gas is used for plasma formation whereby the gaseous atoms in the ions and free electrons in the protective gas are dissociated, a process during which the loaded gas particles are heated to very high temperatures of e.g. 6 600 to 22 200 degrees Celsius. When these highly heated gas particles are transferred across the arc, the loaded plasma particles give off their heat, thus melting simultaneously the consumable electrode and heating or respectively preheating the basic material. This briefly plasticizes the basic material, which prevents excessive heating over a long period of time in the transition zone between the basic material and the filler metal, which in known processes leads to embrittlement of the basic material.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
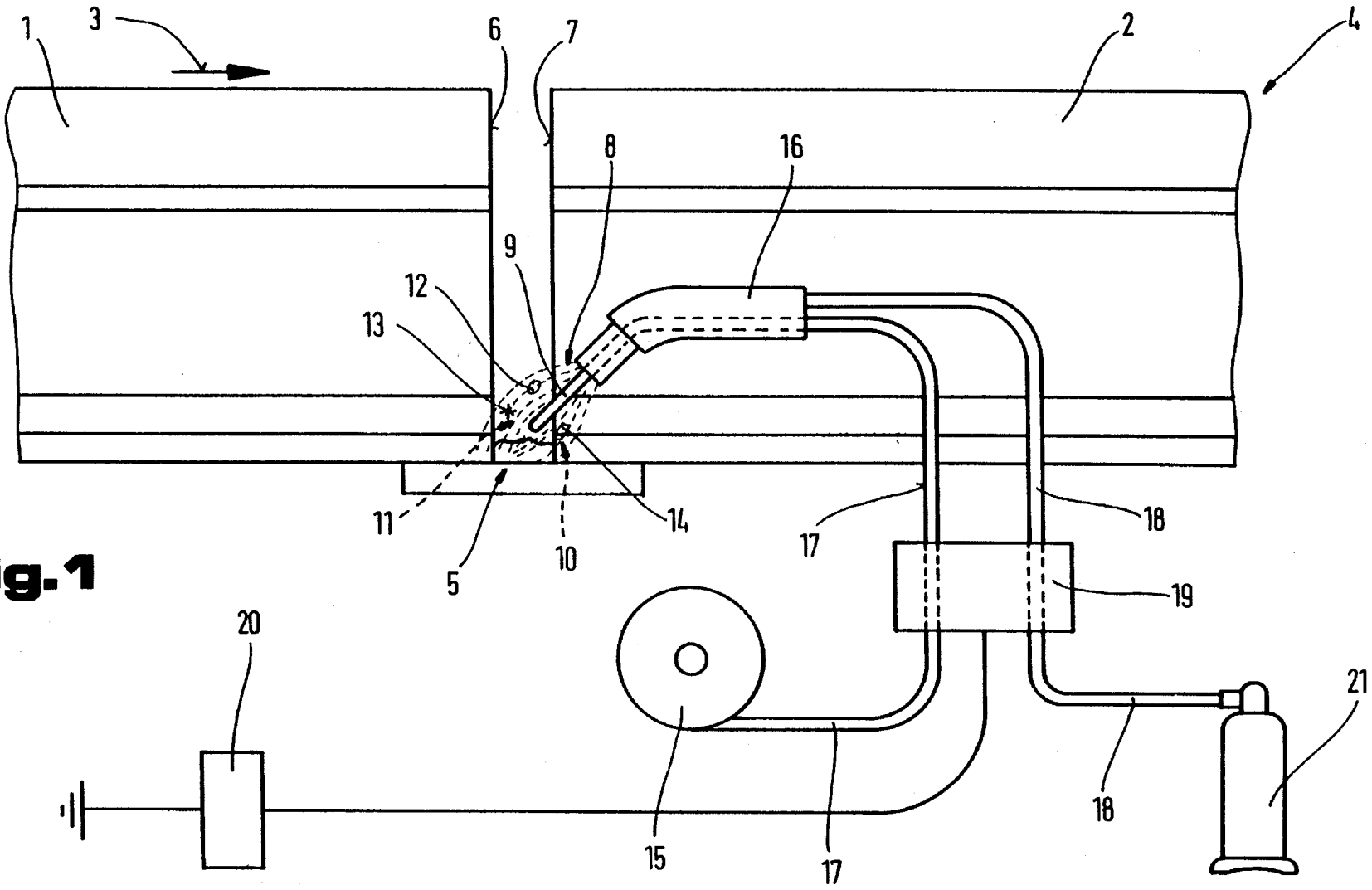
FIG. 1 is a schematic, simplified side view of a rail joint during the production of a weld joint with the appropriate welding system.

FIG. 1 shows two rail sections 1, 2, arranged in a lengthwise direction—arrow 3—one behind another and forming a rail 4 for rail cars such as trains, tramways, cable cars, cranes, etc. The rail sections 1,2 are joined by a weld joint 5 thus connected with each other in a frictional or form-locking manner.

The filler material 8 from the molten consumable electrode 9 is put between the facing ends 6,7 of the two rail sections 1,2. The melting of the filler material 8 occurs over a welding arc 10 built up between the consumable electrode 9 and the rail sections 1,2, and a protective gas envelope 11 consisting of several inert gases 12, 13, 14 prevents oxygen and carbon dioxide from entering the weld area.

The consumable electrode 9, which, for example is composed of a filler wire having an adequate diameter, is pulled off the wire supply coil 15 and brought over to a welding gun 16, through which current is also supplied over a line 17 and through which the entry of the protective gases 12 to 14 and the shielding gas mixture over a conduit 18 occurs. The welding gun 16 is conventionally constructed and includes the required switches to introduce and interrupt the wire movement of the consumable electrode 9 and the current supply or the supply of protective gases 12 to 14 as well as respectively the protective gas mixture, and moreover, is also connected to a control device 19 and a power supply device 20 as well as to a container, such as a gas cylinder 21 for protective gases 12 to 14 or respectively the protective gas mixture.

For the production of the desired welding zones the consumable electrode 9 has a diameter varying from 0.8 mm to 0.4 mm and the power supply device 20 supplies currents in the range of 100 to 1 100 amperes to the consumable electrode 9. The protective gases 12 to 14, or a mixture thereof consists of argon 40% to 70%, helium 25% to 60%, carbon dioxide 3% to 10% and oxygen 0.1% to 1%.

The melt-off output and the current supply of the power supply device 20 is changed and controlled by the control unit to such an extent that between 400 to 1200 globules per second are melted off the consumable electrode 9, which preferably have a diameter which corresponds at least to the size of diameter of the consumable electrode 9.

The above mentioned criteria make it possible to benefit from the advantages of the spray arc metal transfer process with regard to droplet sizes, which under normal circumstances belong to globular transfer processes. Together with the new welding gas mixture and the resulting plasma field it is now possible to keep the increased metal flow volume in the weld joint and achieve a better quality of the weld joint as well as better penetration by means of further preheating of the base material.

Figure 2:
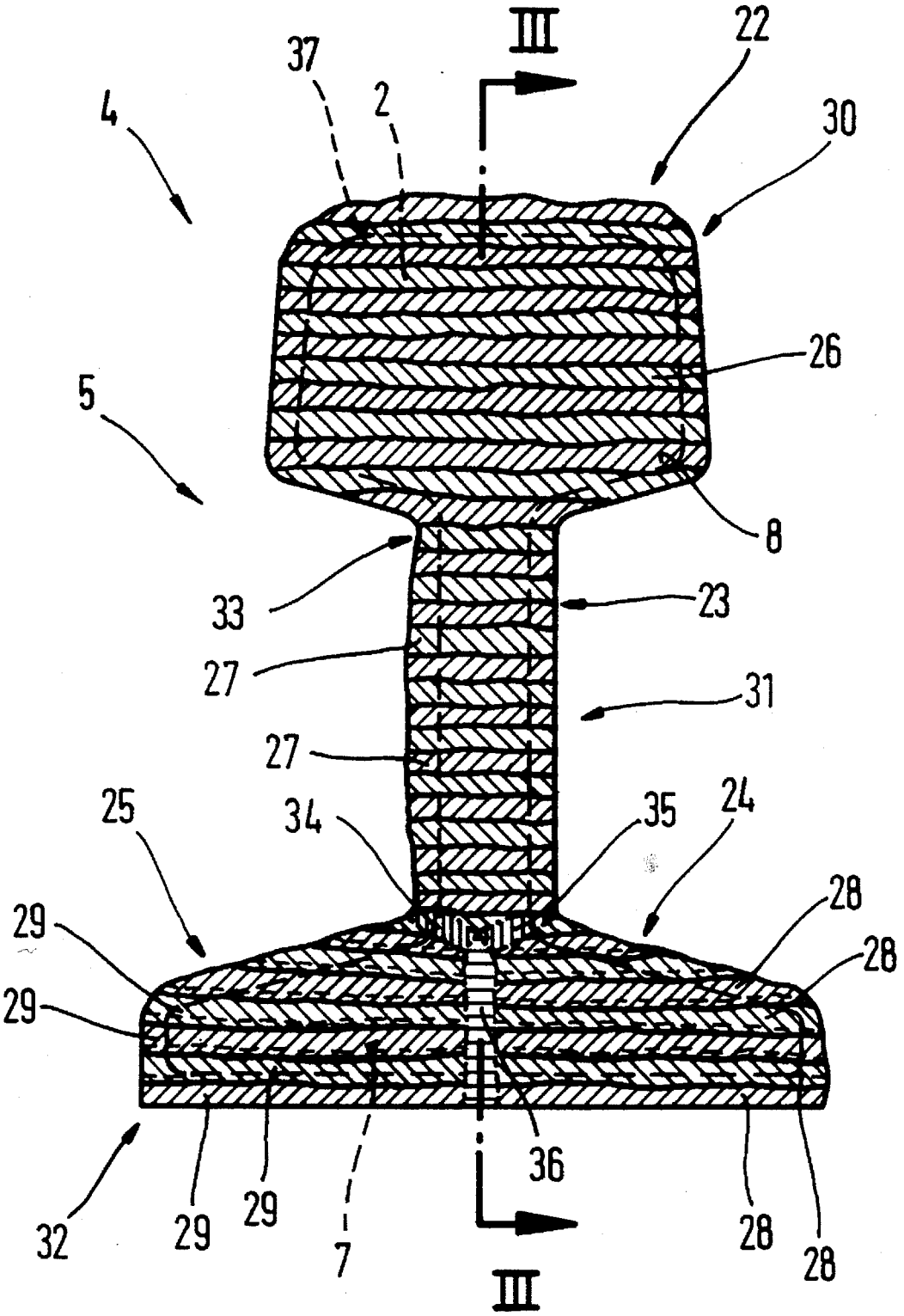
FIG. 2 is a transverse cross section of the weld joint according to the invention.
Figure 3:
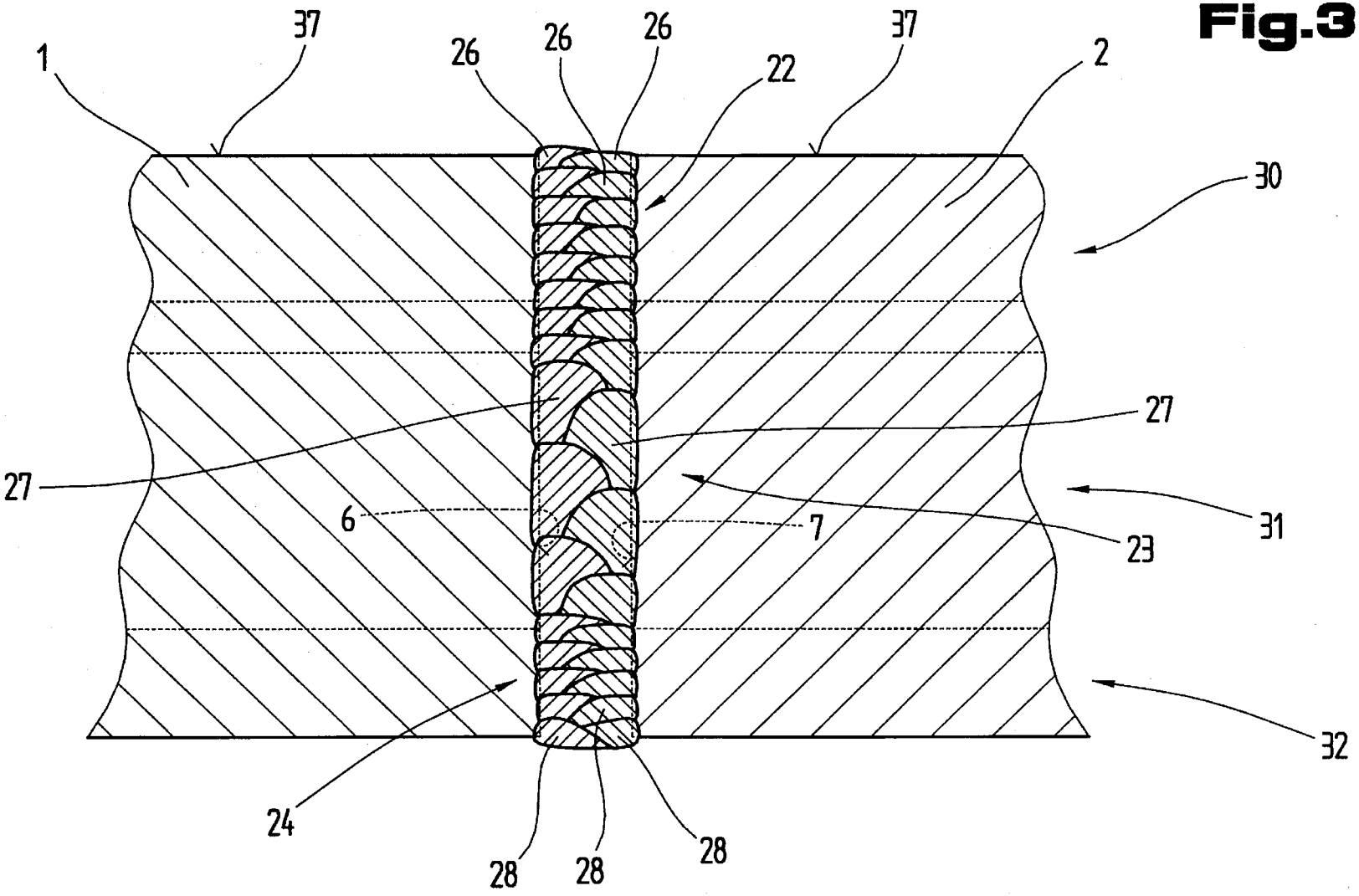
FIG. 3 is a longitudinal cross section of the weld joint, taken in a plane extending in the longitudinal direction of the rail sections.

FIGS. 2 and 3 show a weld joint between two rails 1 and 2, which is composed of several welding zones 22, 23, 24 and 25. The welding zones 24 and 25 can also be formed by one single welding zone.

The schematic views of the welding zones 22 to 25 show that each one of them consists of a multitude of beads 26, 27, 28 and 29. As shown in FIG. 3, these beads 26 to 29 are arranged above each other and essentially parallel to one another between the two facing ends 6,7 of the rail sections 1,2 facing each other. 6 to 8, up to a maximum of 10 beads 26 which essentially run parallel to each other and are arranged one above another, form the welding zone 22 in the region of a rail head 30, whereas the beads 27 form the welding zone 23 in the region of the rail stem 31 and the beads 28 and 29 form the welding zones 24 and 25 in the region of the rail foot 32.

As schematically shown in the region of the rail foot 32, the application of the beads 28 and 29 arranged one above another leads to the melting of an uppermost layer of the underlying beads, as indicated in broken lines. This causes a close bond of the material between the beads arranged on top of each other.

It also can be seen that the welding zones 22 to 25 have melted together in the contact areas 33, 34, 35 and 36, and due to which there is a uniform structural cohension in all spatial directions of the rail sections 1, 2.

This causes the formation of the contact zone 34 between the beads 27 and 29, the contact zone 35 between the beads 27 and 28, and finally the contact zone 36 between the beads 28 and 29 in the region of the rail foot. However, it is also possible to weld the welding zones 24 and 25 in the region of the rail foot 32 as a single welding zone, as illustrated more clearly in the following figures.

The advantage of this uniform structural arrangement is the achievement of standardized mechanical strength properties in the weld joint, which leads to a substantial increase of bending strength and tensile strength.

At the same time there is also a better impact resistance, so that vibrations caused by the wheels running on the rails, particularly in the region of the rail joints even if notches are forming in the region of running surface 37 of the rail head 30, do not shorten the life span of such a weld joint 5.

A weld joint 5 of the type generally achievable with the present invention enables a slow down of embrittlement of the basic materials of the rail sections 1 and 2 in spite of increased heat supply for the removal of more material and a better melt-off of the basic material of the rail sections 1,2, due to cooling devices in the region of the weld joint during production of the individual welding zones 22 to 25.

FIGS. 4 to 9 show the cooling devices 38, 39 and 40 in the appropriate disposition required for the production of the various welding zones 22 to 25. Simultaneously, the sequence of the illustration in FIGS. 4 to 9 results in the process sequence for the weld joint production 5 in accordance with the present invention.

Figure 5:
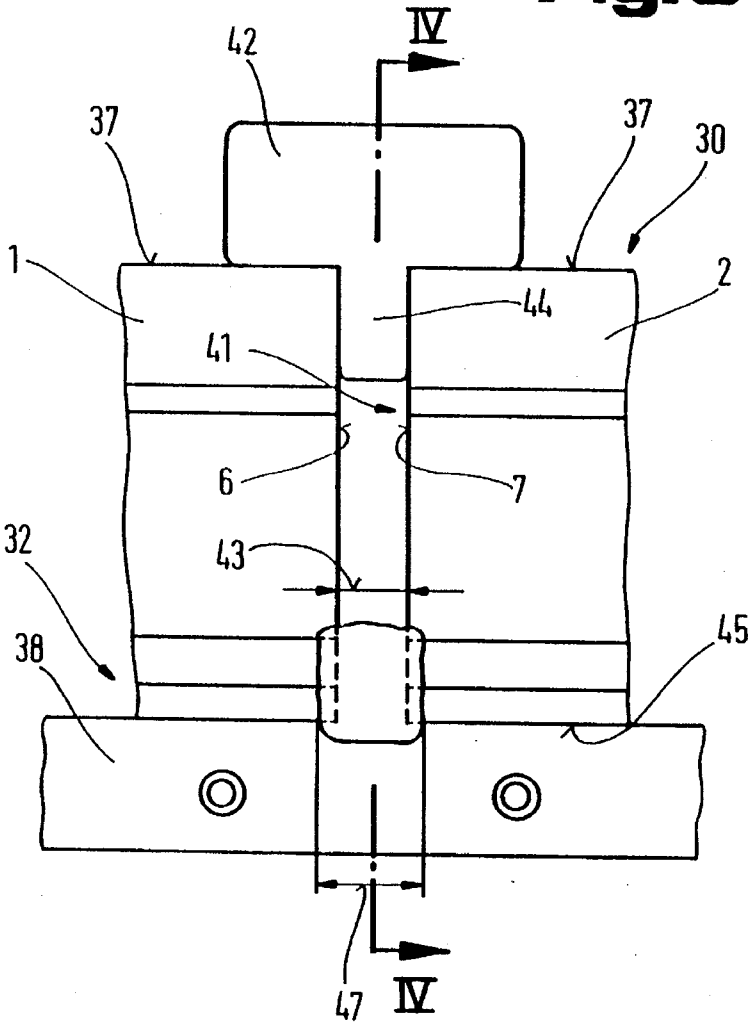
FIG. 5 is a side view of a weld joint according to FIG. 4.
Figure 4:
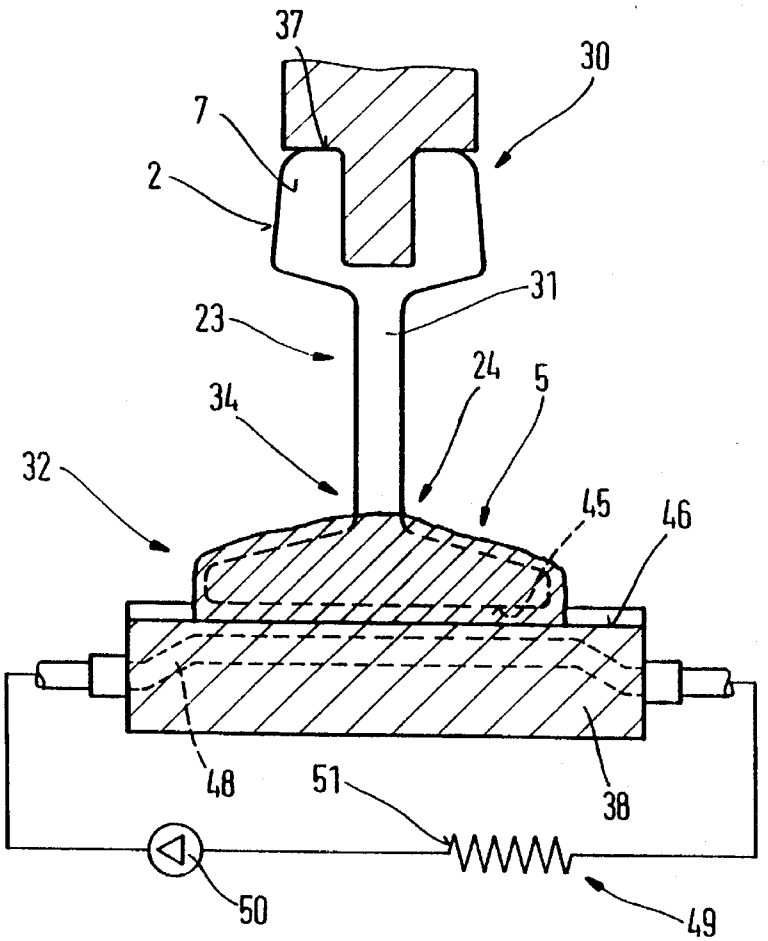
FIG. 4 is a sectional end view of the weld joint with a weld area within the base region of the weld and a cooling device, according to lines IV—IV in FIG. 5.

As shown in FIGS. 4 and 5, a welding gap 41 between the facing ends 6,7 is produced before the production of the weld joint 5 between the facing ends 6 and 7 of the rail sections 1 and 2, by putting a spacer block 42 on the running surface 37 in the region of the rail head 30, and which projects into the welding gap 41 with an adequate projecting part 44 whose thickness 43 is equivalent to that of of the welding gap 41.

The cooling device 38 is located at the support base 45 of the rail sections 1,2 and has a recess 46 whose width 47 is at least equal to the thickness 43 of the welding gap 41 or, as shown in FIG. 5 somewhat larger. This produces an excess of filler metal projecting beyond the support base.

In the region of the rail foot 32 there is only one continuous welding zone 24. This produces contact zone 34 between the welding zone 23 in the region of the stem of the rail 31 and its beads 27, and the welding zone 24 and its beads 28.

Adequate cooling is obtained with a cooling device 38, when the coolant passes through a schematically shown conduit 48 in a schematically shown cooling circuit 49 with a pump 50 and a heat exchanger 51 which cools down the cooling agent. This brings about an adequate temperature in the basic material of rails 1,2 and in the beads 28, 29 adjacent to the base bead.

The spacer block 42 positioned in the region of the rail head 30 prevents that the welding gap 41 in the region of the rail head 30 gets smaller due to temperature stress on the rail sections 1,2 in the region of the rail foot 32. This ensures at the same time a true alignment of the running surfaces 37 of the rail sections 1 and 2 which are welded together.

Since the welding zone 24 and 25 can be produced with a relatively small number of up to a maximum of 10 beads 28, 29, it is possible on the one hand to achieve a close bond between the individual beads 28 and 29, and on the other hand, with the basic material of the rail sections 1,2. In particular, this creates links produced similarly to those of a tie beam, between the rail sections 1,2 which in comparison to the production of such a weld joint by means of electrodes, can be produced with a much smaller number of beads 26 to 29.

Figure 7:
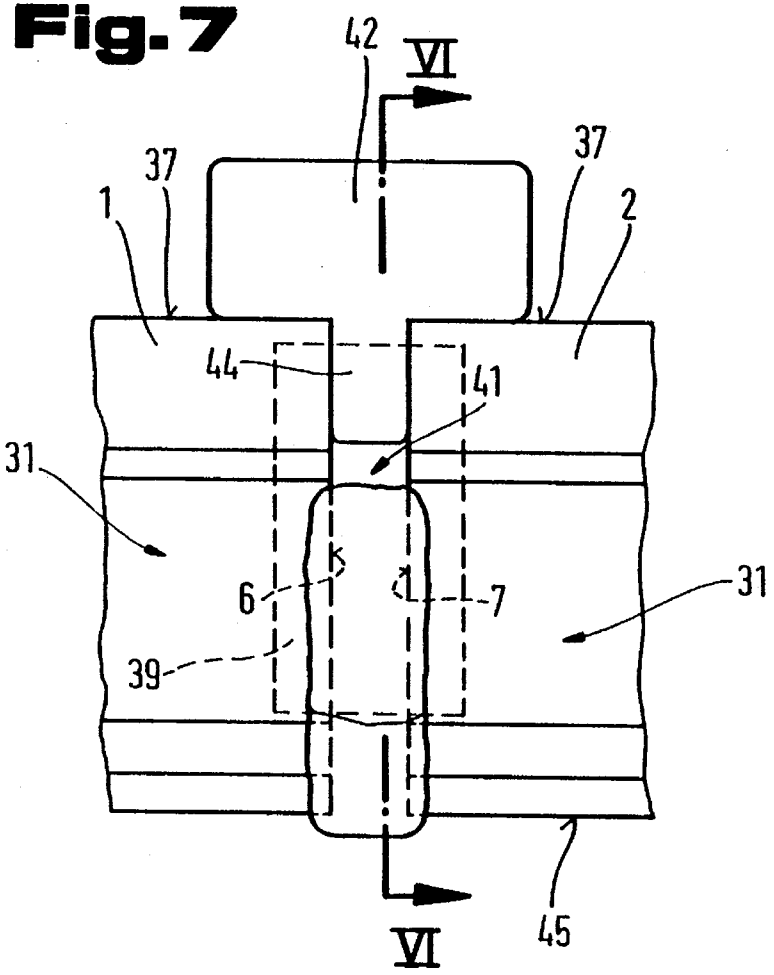
FIG. 7 is a side view of the weld joint according to FIG. 6.
Figure 6:
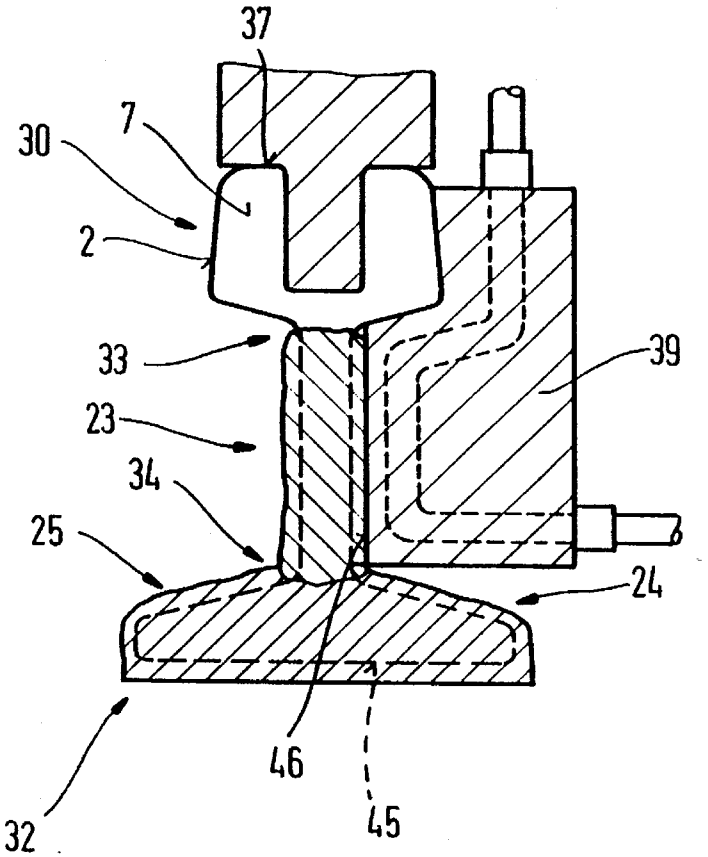
FIG. 6 is a sectional end view of the weld joint with finished weld areas in the region of the weld base and the stem of the rail, with the appropriate cooling device for the stem of the rail with the appropriate cooling device for the stem of the rail, according to lines VI—VI in FIG. 7.
Figure 9:
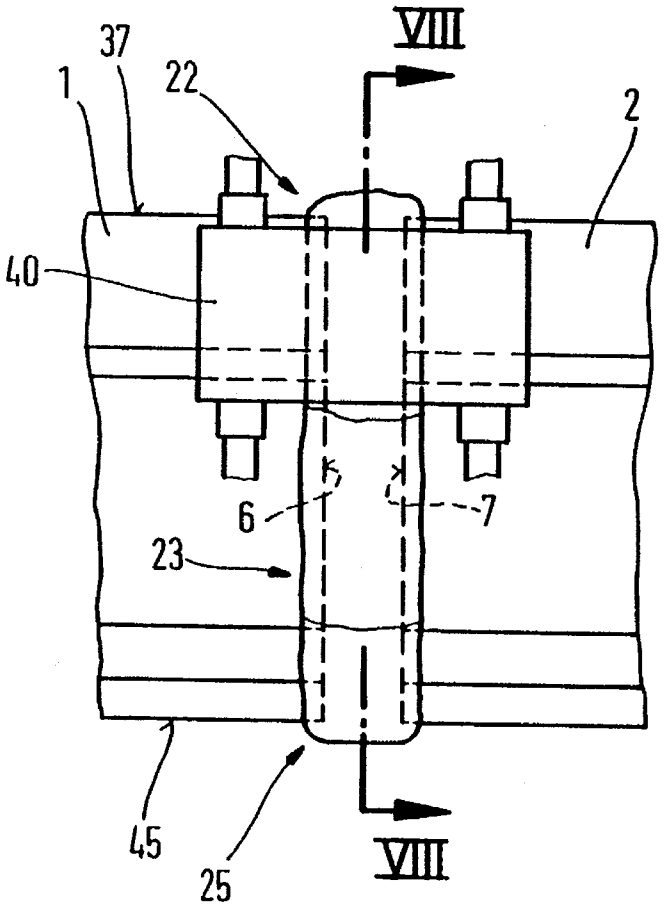
FIG. 9 is a side view of the weld joint according to FIG. 8.
Figure 8:
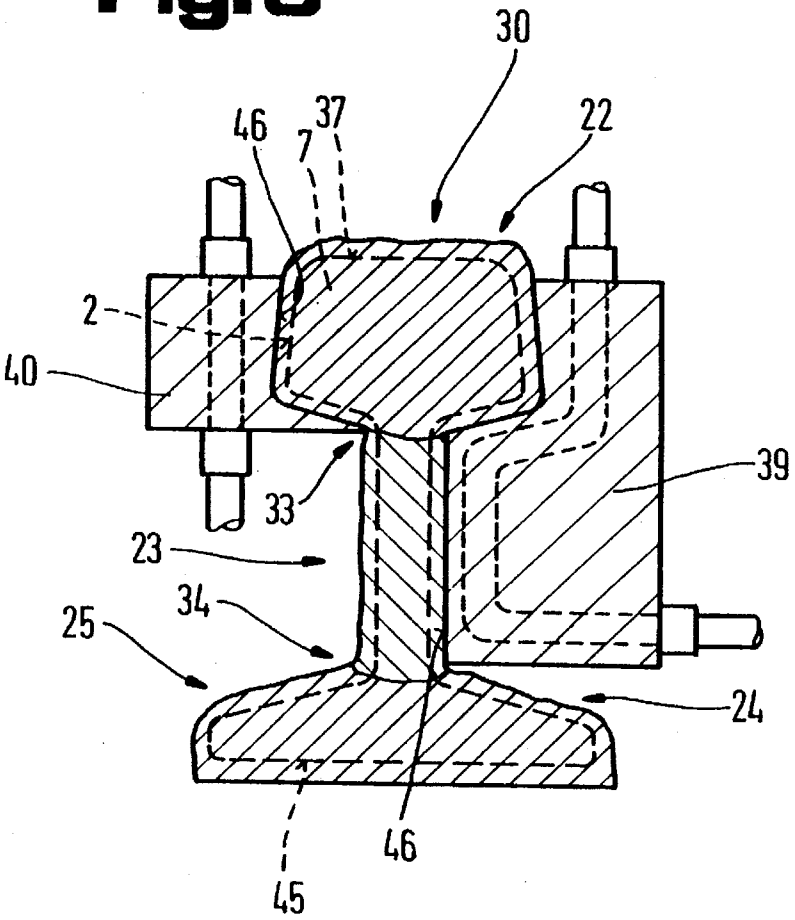
FIG. 8 is a sectional end view of the weld joint with all finished weld areas and the cooling devices for the rail head and the stem of the rail.

After the rail feet 32 of the rail sections 1,2 are welded, and as can be seen from FIG. 6 and 7, a cooling device 39 is mounted on one side of the rail stem 31 and the welding gap 41 between the facing ends 6 and 7 is closed by several horizontal beads 27. However, there is also the possibility to weld the welding gap 41 with vertical beads 27, in which case the cooling device can be put from one side wall of the stem of the rail 31 to the other thus achieving full penetration welding of the stem of the rail stem 31.

After this operation, while the spacer block 42 is still between the facing ends 6,7 of the rails 1,2, said spacer block 42 is removed and in addition to the cooling device 39, a further cooling device 40 is placed on the opposite side of the rail head 30 opposite of the cooling device 39. Thereafter, the welding gap 41 is filled in the region of the rail head 30 with 10 to 12, but not more than 15 beads 26. The cooling devices 39 and 40 just as cooling device 38, have in the region of the welding gap 41 corresponding recesses 46, so that the respective beads 26 to 29 project beyond the surfaces of the rails 1,2. In those regions where said projections interefere with the neighbouring faces of the rail sections 1,2, they can be removed with shearing or grinding machines.

The cooling devices 39 and 40 can have the same cooling circuit 49 as cooling device 38, however, it is also feasible to provide each cooling device 38, 39 or 40 with its own cooling circuit 49.

A further advantage of the present invention is that stresses in the individual cross sectional areas can be easier taken care of by using a multitude of beads 26 to 29 with an appropriate choice of filler material and in particular, with different filler materials. Thus, it is possible to produce for example the uppermost or several beads 26 adjacent to running surfaces 37 different or harder filler materials than the other beads in order to achieve better resistance against wear and tear in the region of the rail head 30, and in particular the running surface 37 or respectively the rail head flanks.

A special advantage of the described process of weld joint 5 production together with the protective gas mentioned in the introduction, is that gaseous atoms are disassociated in ions and free electrons when the plasma is generated, causing the charged gas particles to be heated to very high temperatures. i.e. 6 600 to 22 200 degrees Celsius. If such heated gas particles are passed across the arc, the plasma particles give off their heat so as to both melt the consumable electrode 9 and heat the basic material. Then, the cooled gaseous particles join again to reform the molecular structure of the original gases.

Furthermore, it is very advantageous during the production of the various welding zones 22 to 25 if the different properties of the filler materials 8 in the immediately following beads 26, 27, 28, 29 of a welding zone 22, 23, 24, 25 and the contact areas 33, 34, 35, 36 are not too different. In the event that a great difference, for example in the hardness of the modulus of elasticity, modulus in flexure, elastic expansion or other important properties of the material is required, it is better to increase continuously these values, linearly or exponentially across several layers in order to reach the final value. This prevents inner tensions in the welding seam and cracks, also during future operating stresses.

Moreover, during the production of the individual beads 26 to 29, it is important to take into account that a uniform structure is achieved mainly at high tensile strengths when the individual beads 26 to 29 in the various neighbouring welding zones 22 to 25 are applied one immediately following another. Thus, multiple heating and cooling of weld joint area with all its negative effects such as embrittlement is eliminated. This applies not only to the production of neighbouring beads 26 to 29 in each of the respective welding zones 22 to 25, but also to the immediately successive production of the welding zones close to 22 to 25 in their contact areas 33 to 36 as this prevents inner tensions between the welding zones 22 to 25 and causes that additional structural changes within the contact areas 33 to 36 of the individual welding zones 22 to 25 are avoided.

It has been proven that this welding process is also advantageous when the immediately neighbouring and successively produced beads 26 to 29 of welding zones 22 to 25 adjacent to each other are applied in the opposite welding directions. This has the beneficial effect that structural changes at the beginning of each welding process can be avoided since beads 26 to 29 are produced as a continuously, theoretically zigzagging beads thus avoiding any transfer losses caused by the new welding process in the border area of the welding zone 22 to 25 between the individual beads 26 to 29.

It can also be of great advantage, as shown in FIG. 3A, if the successively produced beads 26 to 29 are offset lengthwise in rail direction in the weld joints 5, but overlapping the bordering areas which are running perpendicularly to the direction of the rails. This offsetting in layers of the beads 26 to 29, for example half way, so as to produce a sort of a composite structure just as in a brick wall, offers a closer denticulation of the individual beads 26 to 29 and of the individual layers of the filler material 8, which, on the whole improves tremendously the properties of this weld joint 5.

Within the scope of said invention, it is of course possible to change any arrangement of the individual elements as shown in the examples of the design or to combine these elements in various different forms.

Moreover, single properties of the mentioned examples may also present their own inventive solution.

Finally, it should also be kept in mind that in the drawings of the examples shown above, some individual parts have been unproportionally enlarged or schematically simplified.

What is claimed is:

1. A weld joint between two adjoining and aligned rail sections extending in a longitudinal direction, each rail section having a rail foot, a rail stem and a rail head forming a running surface, the adjoining rail sections having facing ends extending parallel to each other and transversely to the longitudinal direction, the facing ends defining a gap therebetween and the weld joint connecting the facing ends of the adjoining rail sections, comprising (a) at least one welding zone at the rail section feet, (b) a second welding zone at the rail section stems, and (c) a third welding zone at the rail section heads, (1) the welding zones consisting of superposed rows of abutting beads of a material filling said gap, the beads in said welding zones extending substantially parallel to each other and transversely to the longitudinal direction of the rail sections, and the beads adjacent each other in the longitudinal direction overlapping each other and being offset in the longitudinal direction, (2) adjoining areas of the welding zones being interlocked with each other, (3) the at least one welding zone at the rail section feet consisting of at least three and no more than ten beads, (4) the second welding zone at the rail section stems consisting of at least three and no more than sixteen beads, and (5) the third welding zone at the rail section heads consisting of at least three and no more than fifteen beads.

2. The weld joint of claim 1, wherein the filling material in a surface region in the third welding zone adjacent the running surfaces of the rail heads has a greater hardness than the filling material in the other welding zones.

3. The weld joint of claim 1, wherein the filling materials in the welding zones differ from each other.

4. The weld joint of claim 1, wherein the filling materials in the superposed rows differ from each other.

* * * * *